US009809235B2

(12) United States Patent
Jung et al.

(10) Patent No.: US 9,809,235 B2
(45) Date of Patent: Nov. 7, 2017

(54) AUTOMATIC TRAIN OPERATION SYSTEM IN RAILWAY VEHICLES

(71) Applicant: LSIS CO., LTD., Anyang-si, Gyeonggi-do (KR)

(72) Inventors: Jongchul Jung, Seoul (KR); Yong Gee Cho, Seoul (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/834,301

(22) Filed: Aug. 24, 2015

(65) Prior Publication Data

US 2016/0075357 A1 Mar. 17, 2016

(30) Foreign Application Priority Data

Sep. 15, 2014 (KR) ..... 10-2014-0121883

(51) Int. Cl.
*B61L 25/00* (2006.01)
*B61L 27/04* (2006.01)
(Continued)

(52) U.S. Cl.
CPC ..... *B61L 27/04* (2013.01); *B61L 25/021* (2013.01); *B61L 25/025* (2013.01); *B61L 27/0038* (2013.01); *B61L 27/0094* (2013.01)

(58) Field of Classification Search
None
See application file for complete search history.

(56) References Cited

U.S. PATENT DOCUMENTS

2001/0001131 A1 5/2001 Miller
2007/0135988 A1 6/2007 Kidston et al.
(Continued)

FOREIGN PATENT DOCUMENTS

CN 1906074 1/2007
JP H05284609 10/1993
(Continued)

OTHER PUBLICATIONS

State Intellectual Property Office of the People's Republic of China Application No. 201510582638.5, Office Action dated May 27, 2017, 10 pages.
(Continued)

*Primary Examiner* — John R Olszewski
*Assistant Examiner* — James M McPherson
(74) *Attorney, Agent, or Firm* — Lee, Hong, Degerman, Kang & Waimey

(57) ABSTRACT

The present disclosure relates to an automatic train operation system in railway vehicles, the system including: a speed profile generation unit configured to generate speed profile information based on limited speed profile inputted from outside; a track database stored with track gradient information and track curvature information for each track segment; a train speed controller configured to control a speed of the train using a current position, a current speed and the speed profile information of the train inputted from outside; and a propulsion system fault diagnosis unit configured to diagnose a fault status of the propulsion system based on the current speed of the train, the track gradient information, the track curvature information and propulsion notch information inputted from the train speed controller, and to calculate a performance depreciation ratio when the propulsion system is faulted and to provide the performance depreciation ratio to the train speed controller.

10 Claims, 5 Drawing Sheets

(51) Int. Cl.
*B61L 25/02* (2006.01)
*B61L 27/00* (2006.01)

(56) References Cited

U.S. PATENT DOCUMENTS

2011/0257869 A1* 10/2011 Kumar ..... B61L 3/006
701/103
2013/0320153 A1* 12/2013 Jung ..... B61C 15/12
246/168.1

FOREIGN PATENT DOCUMENTS

JP 2517909 7/1996
KR 10-2006-0077587 7/2006
KR 1020100073861 7/2010

OTHER PUBLICATIONS

Korean Intellectual Property Office Application No. 10-2014-0121883, Office Action dated Sep. 11, 2017, 4 pages.

* cited by examiner

AUTOMATIC TRAIN OPERATION SYSTEM IN RAILWAY VEHICLES

CROSS-REFERENCE TO RELATED APPLICATIONS

Pursuant to 35 U.S.C. §119 (a), this application claims the benefit of earlier filing date and right of priority to Korean Patent Application No. 10-2014-0121883, filed on Sep. 15, 2014, the contents of which are hereby incorporated by reference in their entirety.

BACKGROUND OF THE DISCLOSURE

Field of the Disclosure

The teachings in accordance with the exemplary embodiments of this present disclosure generally relate to an automatic train operation system in railway vehicles configured to control a railway vehicle speed according to fault diagnosis of the propulsion system by diagnosing the fault of propulsion system that generates traction in automatically or unmannedly operated railway vehicles.

Discussion of the Related Art

This section provides background information related to the present disclosure which is not necessarily prior art. The railway vehicles may be interchangeably used by trains.

In general, railway vehicles under manual operation are run by traction when an engineer manipulates a controller in an operation room to input a propulsion notch and transmits an input of the propulsion notch to generate the traction, and the railway vehicles under automatic or unmanned operation are run by transmission of propulsion output by an engineer-replacing ATO (Automatic Train Operation) device to propulsion system of the railway vehicles according to a set speed profile.

If there is developed a fault in the propulsion system of a train to reduce the performance of the train, the drawback is that the train speed becomes slowed due to no generation of traction expected by the engineer or the ATO device from the propulsion output. Furthermore, a train cannot start when there is a failure in the propulsion system of the train. The propulsion system may include an encoder configured to generate an output from an engineer or ATO device in a PWM (Pulse Width Modulation) signal, a traction control unit configured to control a motor speed, and motor and interfaces installed on each driving unit.

In case of manual operation by an engineer, it may be possible to check abnormality of the propulsion system by grasping the traction expected by the engineer and actual movement of train, it is not easy to check the abnormality by train-mounted attendants or control center in case of automatic or unmanned operation by ATO device.

When performance deterioration is generated from the propulsion system, a train may run at a speed lower than an expected speed, whereby the train may arrive at a station at a delayed time due to failure to meet the set operation time, resulting in operation schedules all fouled up.

The prior art of Korean Laid-Open Patent No. 10-2009-0077587 discloses a motor fault diagnosis system in an electric train, where temperatures of inner coils, enclosures and air intakes of motors installed at each train are detected, and when there is a sudden change in temperatures, the sudden change in temperatures is determined as a fault, and temperature information of relevant motor at the changed point, running train speed, position information and master controller status are recorded, which are transmitted to the control center.

Furthermore, the Korean Laid-Open Patent No. 10-2009-0077587 also discloses that fault of a certain motor is remotely grasped when a relevant train is operated by a train operation manager to allow a fast maintenance and repair by accurately recognizing a fault generation time, a speed at the fault generation time and propulsion status at the time of generation of fault.

As discussed above, the prior art has proposed a method of diagnosing a motor fault in the propulsion system of electric train, where temperatures of inner coils, enclosures and air intakes of motors installed at each train are detected, and when there is a sudden change in temperatures, the sudden change in temperatures is determined as a fault.

However, in viewpoint of fault in the propulsion system or performance deterioration, the fault may be caused by various reasons including short-circuits between a propulsion notch output in the ATO device and a PWM generation device, abnormality at the PWM generation device, abnormality of interface between the PWM generation device and the propulsion system or abnormality at the motors.

Thus, the prior art suffers from disadvantages in that it is difficult to diagnose faults or performance deteriorations generated by other reasons when the fault is determined only by detecting an over-heat of a motor.

SUMMARY OF THE DISCLOSURE

This section provides a general summary of the disclosure, and is not a comprehensive disclosure of its full scope or all of its features.

Exemplary aspects of the present disclosure are to substantially solve at least the above problems and/or disadvantages and to provide at least the advantages below. Accordingly, an aspect of the present disclosure provides an automatic train operation system in railway vehicles configured to control a railway vehicle speed according to fault diagnosis of the propulsion system by diagnosing the fault of propulsion system that generates traction in automatically or unmannedly operated railway vehicles.

It should be emphasized, however, that the present disclosure is not limited to a particular disclosure, as explained above. It should be understood that other technical subjects not mentioned herein may be appreciated by those skilled in the art.

In one general aspect of the present disclosure, there is provided an automatic train operation system in railway vehicles mounted on the railway vehicles and configured to control speed of the railway vehicles while performing automatic or unmanned operation, the system comprising:

a speed profile generation unit configured to generate speed profile information based on limited speed profile inputted from outside;

a track (railway line) database stored with track gradient information and track curvature information for each track segment;

a train (railway vehicle) speed controller configured to control a speed of the train using a current position, a current speed and the speed profile information of the train inputted from outside; and a propulsion system fault diagnosis unit configured to diagnose a fault status of the propulsion system based on the current speed of the train, the track gradient information, the track curvature information and propulsion notch information inputted from the train speed controller, and to calculate a performance depreciation ratio when the propulsion system is faulted and to provide the performance depreciation ratio to the train speed controller.

Preferably, but not necessarily, the track database, the database being stored with the current position of the train, the track gradient information and the track curvature information, may be provided to the propulsion system fault diagnosis unit when there is a request from the propulsion system fault diagnosis unit.

Preferably, but not necessarily, the train speed controller may output a propulsion command when the profile speed at the current position of the train is greater than the current speed of the train, and may output a brake command when the profile speed at the current position of the train is smaller than the current speed of the train.

Preferably, but not necessarily, the train speed controller may output the propulsion notch information in proportion to size of error between the profile speed at the current position of the train and the current speed of the train.

Preferably, but not necessarily, the train speed controller may compensate the performance depreciation by increasing a propulsion notch value by adding a propulsion notch in response to a degree of the performance depreciation ratio provided by the propulsion system fault diagnosis unit.

Preferably, but not necessarily, the propulsion system fault diagnosis unit may include, a traction (force) calculation unit configured to calculate a required traction (force) using the current speed of the train and the propulsion notch information, an acceleration calculation unit configured to calculate a current acceleration using the current speed of the train and a previously stored speed, a train model unit configured to calculate a required acceleration using the current speed of the train, the required traction, the track curvature information and track gradient information, and a fault status diagnosis unit configured to calculate the performance depreciation ratio in response to a degree of error by calculating a relative acceleration error by receiving the current acceleration and the required acceleration and by determining that the propulsion system is in fault when the relative acceleration error is greater than a set value.

Preferably, but not necessarily, the traction calculation unit may include a look-up table configured by propulsion notch information and required traction of each speed, and calculates the required traction using the look-up table.

Preferably, but not necessarily, the propulsion system fault diagnosis unit may include storage configured to store the current speed of the train and provide the stored current speed of the train to the acceleration calculation unit at a next step.

Preferably, but not necessarily, the train model unit may calculate the required acceleration using the following Equation:

$$A_D(k) = \frac{F_D(k) - c_1 - c_2 V(k) - c_3 V(k)^2 - c_4 / r(k) - mg\sin\theta(k)}{m}$$

where, $A_D(k)$ is a required acceleration predicted from a current speed and propulsion notch, $F_D(k)$ is a required traction, $c_1$, $c_2$, $c_3$ are constants related to running resistances, V(k) is a current speed, m is an equivalent mass of a train, g is a gravitational acceleration constant, r(k) is a track curvature, $c_4$ is a constant related to curvature resistance, and θ(k) is a track gradient.

Preferably, but not necessarily, the fault status diagnosis unit may be configured to calculate the performance depreciation ratio using the following Equation:

$$DR = (1 - \alpha) \times \left( \frac{A_D(k) - A(k)}{A_D(k)} - \alpha \right) \times 100[\%]$$

where, DR is a performance depreciation ratio, $A_D(k)$ is a required acceleration, A(k) is a current acceleration, $\alpha(0<\alpha<1)$ is a set value and, $$\frac{A_D(k) - A(k)}{A_D(k)}$$

is a relative acceleration error.

Preferably, but not necessarily, the performance depreciation ratio may be calculated as 0% when the relative acceleration error value is smaller than the set value, the performance depreciation ratio may be calculated as 100% when the relative acceleration error value is greater than 1, and the performance depreciation ratio may be proportionally calculated in response to {100/(1-set value)} value when the relative acceleration error value is between the set value and 1.

Preferably, but not necessarily, the automatic train operation system in railway vehicles may further comprise a data transmission unit configured to transmit fault status information and performance depreciation ratio to an ATS (Automatic Train Stop) by receiving the fault status information and performance depreciation ratio from the propulsion system fault diagnosis unit.

The teachings in accordance with the exemplary embodiments of this present disclosure have an advantageous effect in that a fault of propulsion system that generates traction in automatically or unmannedly operated railway vehicles is diagnosed to control a train (railway vehicle) speed according to fault diagnosis of the propulsion system.

Another advantageous effect is that a train speed can be controlled by calculating a performance depreciation degree when fault is generated in propulsion system.

As a result, headway of a train mismatched by performance depreciation of propulsion system can be prevented by controlling a train speed in response to performance depreciation degree of the propulsion system.

Furthermore, fault information of the propulsion system can be transmitted to an ATS to allow recognizing the fault of the propulsion system and rapidly establishing a measure thereto.

Other exemplary aspects, advantages, and salient features of the disclosure will become more apparent to persons of ordinary skill in the art from the following detailed description, which, taken in conjunction with the annexed drawings, discloses exemplary embodiments of the invention.

BRIEF DESCRIPTION OF THE DRAWINGS

The accompanying drawings, which are included to provide a further understanding of the disclosure and are incorporated in and constitute a part of this application, illustrate embodiment(s) of the disclosure, and together with the description serve to explain the principle of the disclosure. In the drawings.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

It is to be understood that both the foregoing general description and the following detailed description of the present disclosure are exemplary and explanatory and are intended to provide further explanation of the disclosure as claimed.

DETAILED DESCRIPTION

Advantages and characteristics of the present embodiment and methods for addressing the same will be clearly understood from the following embodiments taken in conjunction with the annexed drawings. However, the present disclosure is not limited to the embodiments and may be realized in various other forms. The embodiments are only provided to more completely illustrate the present disclosure and to render a person having ordinary skill in the art to fully understand the scope of the present disclosure. The scope of the present disclosure is defined only by the claims. Accordingly, in some embodiments, well-known processes, well-known device structures and well-known techniques are not illustrated in detail to avoid unclear interpretation of the present disclosure. The same reference numbers will be used throughout the specification to refer to the same or like parts.

Detailed descriptions of well-known functions, configurations or constructions are omitted for brevity and clarity so as not to obscure the description of the present disclosure with unnecessary detail. Thus, the present disclosure is not limited to the exemplary embodiments which will be described below, but may be implemented in other forms.

The meaning of specific terms or words used in the specification and claims should not be limited to the literal or commonly employed sense, but should be construed or may be different in accordance with the intention of a user or an operator and customary usages. Therefore, the definition of the specific terms or words should be based on the contents across the specification.

Now, configuration and function of ATO device for controlling a train speed in an automatic or unmanned mode according to exemplary embodiments of the present disclosure will be explained in detail together with the figures.

Figure 1:
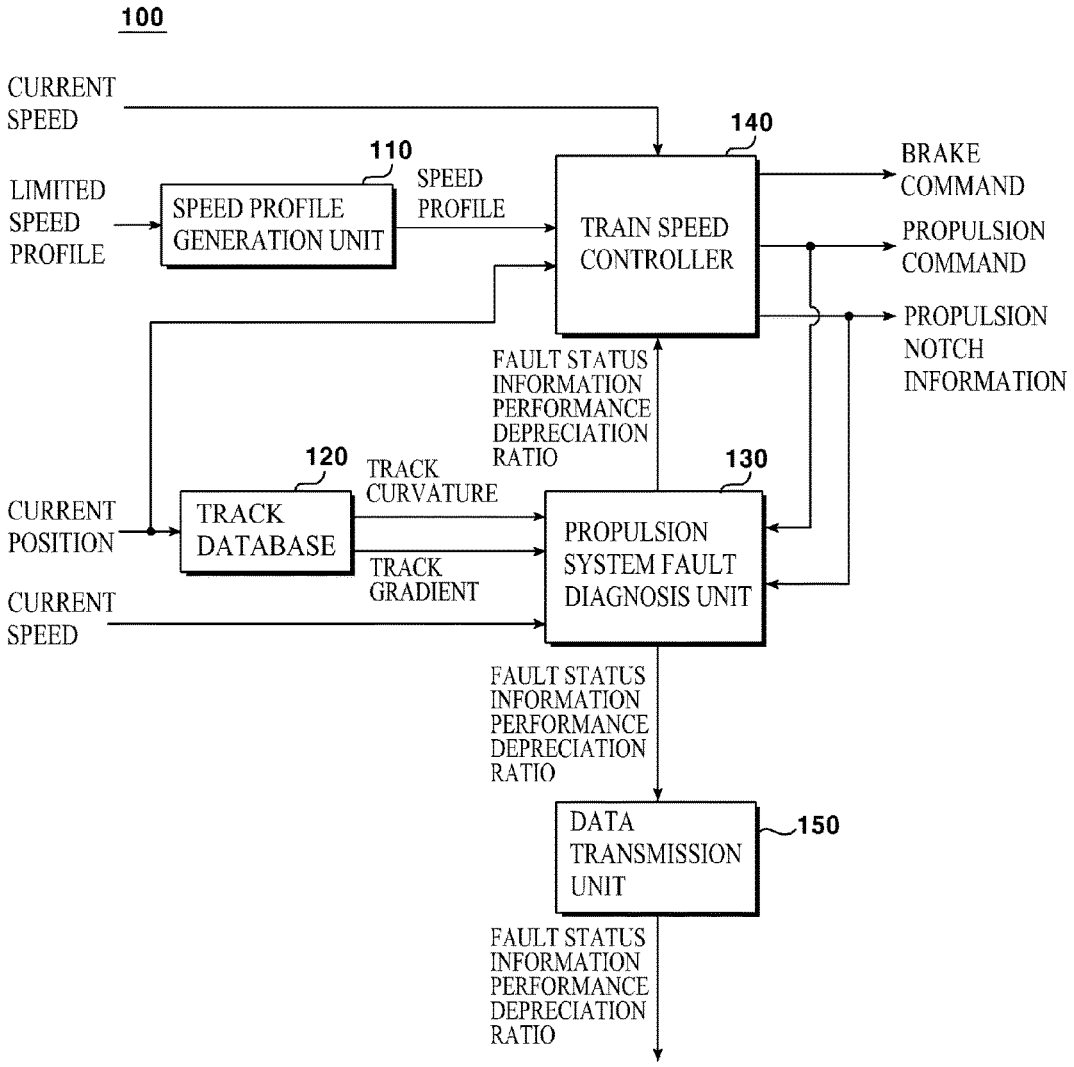
FIG. 1 is a block diagram illustrating an automatic train operation system in railway vehicles according to an exemplary embodiment of the present disclosure.

FIG. 1 is a block diagram illustrating an automatic train operation system in railway vehicles according to an exemplary embodiment of the present disclosure.

Referring to FIG. 1, an automatic train operation system (100) in railway vehicles according to an exemplary embodiment of the present disclosure may include a speed profile generation unit (110), a track (railway line) database (120), a propulsion system fault diagnosis unit (130), a train (railway vehicle) speed controller (140) and a data transmission unit (150).

The speed profile generation unit (110) may generate speed profile information based on inputted limited speed profile. At this time, the speed profile generation unit (110) may receive the limited speed profile from ATP (Automatic Train Protection) on-board equipment. The track database (120) may be stored with gradient information for each track segment and track curvature information, receive current position information of the train inputted from outside, and output the track gradient and track curvature information based on the current position information of the train. At this time, the speed profile generation unit (110) may receive the limited speed profile from ATP (Automatic Train Protection) on-board equipment.

The propulsion system fault diagnosis unit (130) may diagnose a fault status of the propulsion system, based on the current speed of the train inputted from outside (ATP on-board equipment or tachometer), the track gradient information and the track curvature information inputted from the track database (120), propulsion command and propulsion notch information inputted from the train speed controller (140), and calculate a performance depreciation ratio when the propulsion system is faulted.

At this time, the propulsion system fault diagnosis unit (130) may provide the fault status information which is a result of diagnosis of the fault status and the performance depreciation ratio to the train speed controller (140) and the data transmission unit (150). Detailed configuration and operation of the propulsion system fault diagnosis unit (130) will be described with reference to FIG. 2.

Meantime, the data transmission unit (150) may transmit to a control system fault status information and performance depreciation ratio inputted from the propulsion system fault diagnosis unit (130). The train speed controller (140) may control a train speed using the current position information of a train, current speed information, and speed profile information generated by the speed profile generation unit (110). At this time, the train speed controller (140) may output a propulsion command when the profile speed at the current position of the train is greater than the current speed of the train, and output a brake command when the profile speed at the current position of the train is smaller than the current speed of the train.

Furthermore, the train speed controller (140) may determine propulsion notch information or brake notch information in proportion to size of error between the profile speed at the current position of the train and the current speed of the train.

The train speed controller (140) may further use the fault status information in controlling the train speed using the performance depreciation ratio provided by the propulsion system fault diagnosis unit (130).

That is, the train speed controller (140) may receive the fault status information and the performance depreciation ratio provided by the propulsion system fault diagnosis unit (130), and the train speed controller (140) may compensate the performance depreciation of the propulsion system by increasing a propulsion notch in addition to a propulsion notch in response to a degree of the performance depreciation ratio provided by the propulsion system fault diagnosis unit, when it is determined that the propulsion system is in fault. That is, the performance depreciation of the propulsion system is compensated by adding a propulsion notch in proportion to the performance depreciation ratio.

The following Equation 1 is an equation to a control input (u) for a propulsion system being in a normal state, when using a proportional controller, and the following Equation 2 is an equation to a control input (u') for propulsion when performance depreciation is generated on the propulsion system.

$$u=K_P \times e \quad \text{[Equation 1]}$$

$$U'=K_P \times e+K_{DR} \times \mathrm{DR} \quad \text{[Equation 2]}$$

where, u, u' are control efforts, $K_P$ is a proportional control gain, e is a speed error, which is defined by a value where a profile speed is subtracted by current speed of the train, and KDR is a constant related to performance depreciation (performance depreciation constant), and DR is a performance depreciation ratio.

As ascertained from [Equation 1], when the propulsion system is in normal state, the propulsion control input (u) is indicated by a value where the proportional control gain is multiplied by the speed error, and as ascertained from [Equation 2], when the propulsion system is developed with performance depreciation on the propulsion system, the propulsion control input (up is shown where the performance depreciation ratio is added.

Thus, when the performance is depreciated due to development of fault on the propulsion system, an additional traction is generated to increase the train speed whereby the headway is compensated.

Figure 2:
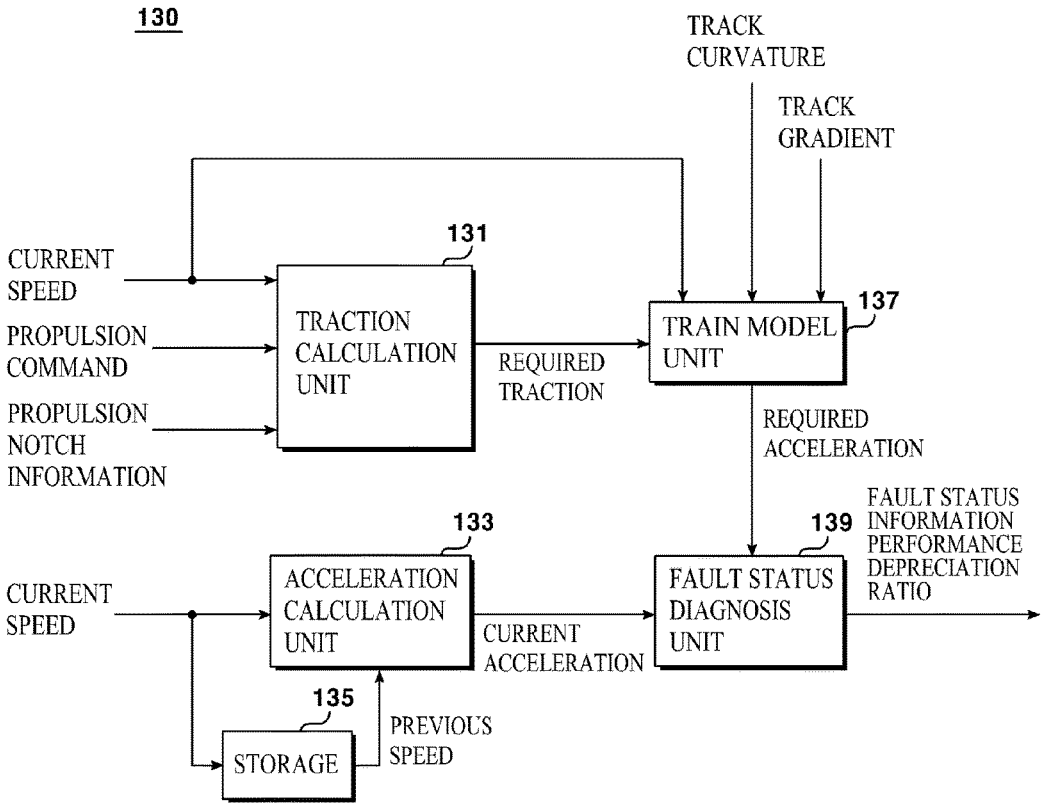
FIG. 2 is a block diagram illustrating a detailed configuration of a propulsion system fault diagnosis unit according to an exemplary embodiment of the present disclosure.

FIG. 2 is a block diagram illustrating a detailed configuration of a propulsion system fault diagnosis unit according to an exemplary embodiment of the present disclosure;

Referring to FIG. 2, the propulsion system fault diagnosis unit (130) according to an exemplary embodiment of the present disclosure may diagnose a fault status of the propulsion system based on the current speed of the train inputted from outside (ATP on-board equipment or tachometer), the track gradient information and the track curvature information inputted from the track database (120), and propulsion command and notch information inputted from the train speed controller (140), and to calculate a performance depreciation ratio when the propulsion system is faulted.

The propulsion system fault diagnosis unit (130) may include a traction calculation unit (131), an acceleration calculation unit (133), storage (135), a train model unit (137) and a fault status diagnosis unit (139).

When the traction calculation unit (131) receives a propulsion command, a required traction can be calculated using the current speed information and the propulsion notch information. At this time, the current speed means a current speed of the train, and may be provided and measured by a sensor such as tachometer or ATP on-board equipment.

Meantime, the propulsion command and the propulsion notch information may be outputted from the train speed controller (140) of the automatic train operation system (100), and feedbacked to the propulsion system fault diagnosis unit (130).

At this time, the train traction system can generate other tractions in response to the propulsion notch and train speed, where the traction calculation unit (131) may include a look-up table for extracting propulsion notch and required traction for each train speed to simulate a propulsion system mounted on an actual train. That is, the traction calculation unit (131) may extract a traction predicted under the current state from the look-up table using the current propulsion notch information and speed information. Meantime, as another exemplary embodiment, the traction calculation unit (131) may include an equation for calculating traction instead of a look-up table.

The acceleration calculation unit (133) may calculate a current acceleration using a current speed and a previous speed. To this end, the propulsion system fault diagnosis unit (130) may include storage (135) where a current speed is stored, and the stored speed is provided as a previous speed at a next step. That is, the storage (135) can store a current speed and provide the current speed to the acceleration calculation unit (133) at the next step. The current acceleration A(k) may be defined by the following Equation 3.

$$A(k)=\frac{V(k)-V(k-1)}{\Delta} \quad \text{[Equation 3]}$$

where, A(k) is a current acceleration, V(k) is a current speed, V(k−1) is a previous speed and Δ is a sampling period.

The train model unit (137) may calculate a required acceleration using a current speed, a required traction, a track curvature and track gradient information. A train model used for calculating the required acceleration is a DOF (Degree of Freedom) longitudinal train model, which may be calculated by the following Equation 4:

$$A_D(k)=\frac{F_D(k)-c_1-c_2V(k)-c_3V(k)^2-c_4/r(k)-mg\sin\theta(k)}{m} \quad \text{[Equation 4]}$$

where, $A_D(k)$ is a required acceleration predicted from a current speed and propulsion notch, $F_D(k)$ is a required traction, $c_1$, $c_2$, $c_3$ are constants related to running resistances, V(k) is a current speed, m is an equivalent mass of a train, g is a gravitational acceleration constant, r(k) is a track curvature, $c_4$ is a constant related to curvature resistance, and θ(k) is a track gradient.

That is, the train acceleration can be obtained by division, by train mass, of a value where traction applied to the train is subtracted by running resistance, curvature resistance and gradient resistance.

The running resistance applied to the train includes friction resistance and air resistance, and a function of a train speed. The gradient resistance by gradient of track is calculated by a value proportion to a mass and gradient degree, and the curvature resistance by curvature of the track is calculated by a value reverse proportionate to the size of curvature. To wrap up, the predicted required acceleration may be calculated by using a current speed of the train, a required traction predicted in response to the propulsion notch and the current speed of the train, gradient information of track at a relevant position and curvature information of the track.

The fault status diagnosis unit (139) may diagnose whether there is a fault on the propulsion system, and when it is determined that the propulsion system is in fault, the fault status diagnosis unit (139) may calculate the performance depreciation ratio of how much degree the performance is depreciated in comparison with where the propulsion system is in normal state.

That is, the fault status diagnosis unit (139) may compare the current acceleration calculated by the acceleration calculation unit (133) with the required acceleration calculated by the train model unit (137) by receiving the current acceleration calculated by the acceleration calculation unit (133) and the required acceleration calculated by the train model unit (137) to calculate a relative acceleration error, and when the relative acceleration error is greater than a set value, the fault status diagnosis unit (139) determines that the propulsion system is abnormal, and calculates the performance depreciation ratio in response to the degree of the error.

The fault status diagnosis unit (139) may determine whether the propulsion system is abnormal according to the following Equation 5.

$$\text{if}\left(\frac{A_D(k)-A(k)}{A_D(k)}\right)>\alpha,\quad \text{fault} \qquad \text{else,}\quad \text{no fault} \qquad \text{[Equation 5]}$$

where, $A_D(k)$ is a required acceleration, A(k) is a current acceleration, and α is a set value (threshold), where the set value (α) is set at a value between 0 and 1.

That is, the fault status diagnosis unit (139) may determine that the propulsion system is abnormal when a status acceleration error value {acceleration error value (required acceleration is subtracted by current acceleration) is divided by a required acceleration} is greater than a set value, and other cases are determined as the propulsion system is normal.

Figure 3:
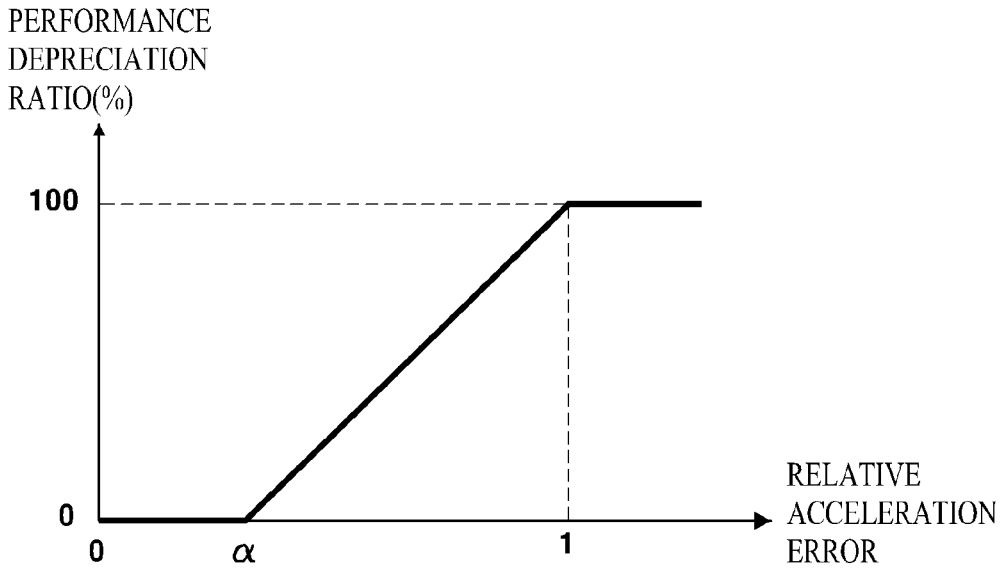
FIG. 3 is a graph illustrating a performance depreciation ratio of a propulsion system in response to a relative acceleration error.

Meantime, FIG. 3 is a graph illustrating a performance depreciation ratio of a propulsion system in response to a relative acceleration error, where X axis defines a relative acceleration error, Y axis indicates a performance depreciation ratio, and a relative acceleration error ($e_A(k)$) at k-step may be expressed by the following Equation 6.

$$e_A(k)=\frac{A_D(k)-A(k)}{A_D(k)} \qquad \text{[Equation 6]}$$

where, $A_D(k)$ is a required acceleration, A(k) is a current acceleration and the performance depreciation ratio (DR) may be calculated by the following Equation 7 based on the Equation 6.

$$DR=(1-\alpha)\times\left(\frac{A_D(k)-A(k)}{A_D(k)}-\alpha\right)\times 100[\%] \qquad \text{[Equation 7]}$$

where, DR is a performance depreciation ratio, and has a value between 0% and 100%, α is a set value (threshold) and set at a value between 0 and 1. At this time, when the relative acceleration error value is smaller than the set value, the performance depreciation ratio is determined as 0%, when the relative acceleration error value is greater than 1, the performance depreciation ratio is determined as 100%, and when the relative acceleration error value is between a set value and 1, the performance depreciation ratio is proportionally determined by 100/(1−α) value.

Figure 4:
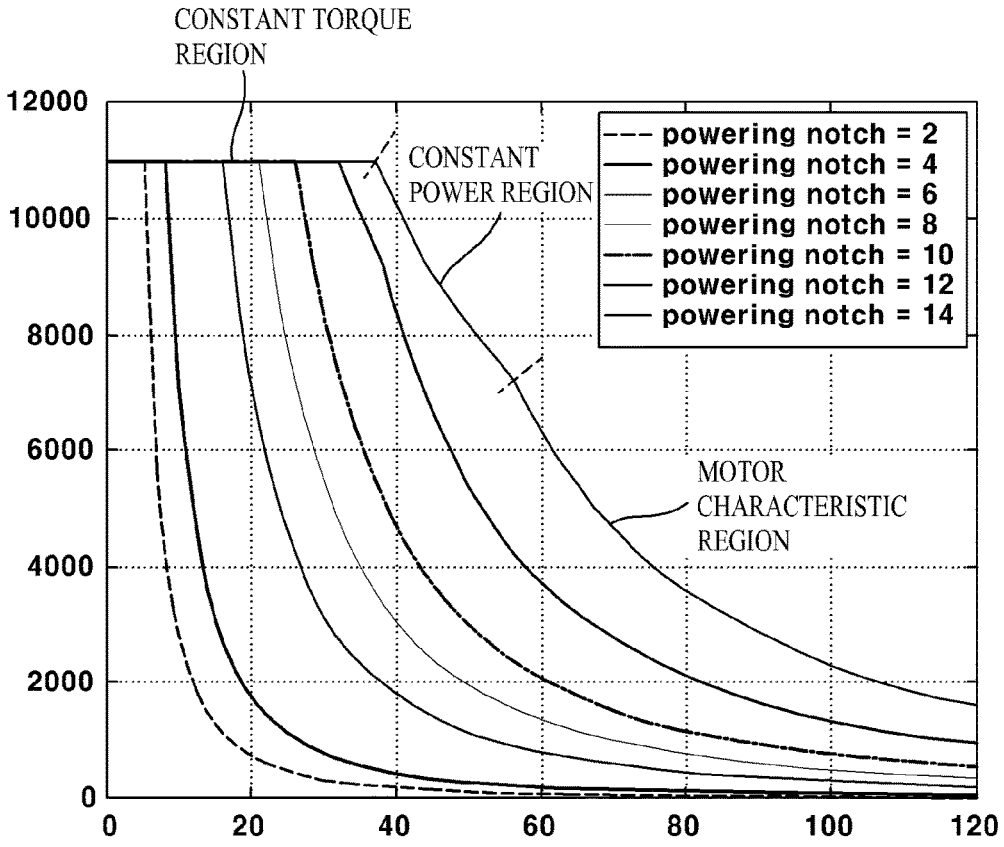
FIG. 4 is a graph illustrating examples of propulsion notch and traction generated by propulsion system.

Meantime, FIG. 4 is a graph illustrating examples of propulsion notch and traction generated by propulsion system for each train, where an output of a motor is classified into a constant torque region, a constant power region, and a motor characteristic region, and different tractions are generated by each propulsion notch and speed scopes.

Although FIG. 4 has exemplified that the propulsion notch exists up to 14 notches by increasing by one step from 1 notch to 14 notches, it should be noted that FIG. 4 has illustrated only traction characteristic curvature relative to even propulsion notches. It should be also appreciated that the propulsion notch may vary depending on railway vehicles.

In case of propulsion 14 notches in FIG. 4, a motor of a propulsion system shows characteristic of a constant torque region up to a train speed of 35 km/h, and outputs a constant traction of approximately 1000 kgf.

Meantime, a motor of a propulsion system shows characteristic of a constant power region up to a train speed of 35~55 km/h, and the traction decreases in reverse proportion to the speed of the train. Furthermore, a motor of a propulsion system shows a motor region characteristic when a train speed is over 55 km/h, and the traction decreases in reverse proportion to square of train speed.

A look-up table may be generated relative to the traction based on graph characteristics as shown in FIG. 4, and the graph characteristics of FIG. 4 may be expressed by mathematical expressions.

Therefore, the traction calculation unit (131) may extract from the look-up table the traction predicted under a current status using the current propulsion notch information and speed information, or calculate the traction using the mathematical expressions for calculating the tractions.

Now, operation of a propulsion system fault diagnosis unit according to an exemplary embodiment of the present disclosure, and a fault diagnosis method of propulsion system according to an exemplary embodiment of the present disclosure will be described step by step with reference to FIG. 5.

Figure 5:
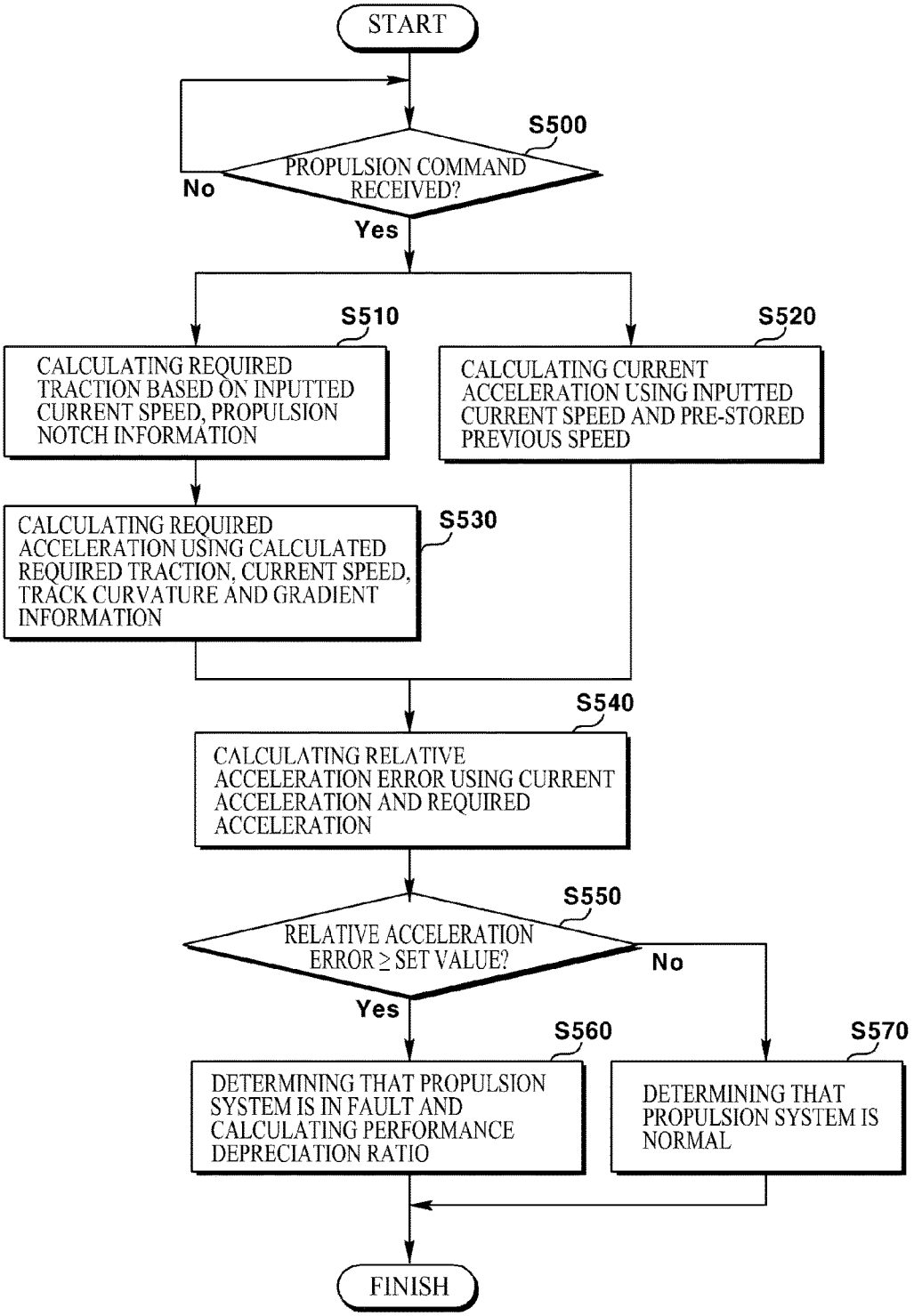
FIG. 5 is a flowchart illustrating an operation process of a propulsion system fault diagnosis unit according to an exemplary embodiment of the present disclosure.

FIG. 5 is a flowchart illustrating an operation process of a propulsion system fault diagnosis unit according to an exemplary embodiment of the present disclosure.

Referring to FIG. 5, the propulsion system fault diagnosis unit may determine whether a propulsion command is received (S500), and check whether it is under the propulsion status.

At this time, as a result of determination whether the propulsion command is received according to step S500, if it is determined that the propulsion command is not received (S500-No), the propulsion system fault diagnosis unit may continuously check if the propulsion command has been received. Selectively, when it is determined that the propulsion command is not received, the propulsion system fault diagnosis may be terminated.

Meantime, as a result of determination whether the propulsion command is received according to step S500, if it is determined that the propulsion command is received (S500-Yes), the traction calculation unit (131) may calculate the required traction based on the inputted current speed and propulsion notch information (S510), and the acceleration calculation unit (133) may calculate the current acceleration using the inputted current speed and pre-stored previous speed (S520).

Next, when the required traction is calculated according to step S510, the train model unit (137) may calculate the required acceleration using the current speed, track curvature and gradient information (S530).

Successively, the fault status diagnosis unit (139) may calculate a relative acceleration error using the current acceleration calculated by step S520 and the required acceleration calculated by step S530 (S540), and may determine whether the relative acceleration error is greater than the set value (S550).

At this time, as a result of determining whether the relative acceleration error is greater than the set value according to step S550, if it is determined that the relative acceleration error is greater than the set value(S550-Yes), it is determined that the propulsion system is in fault, and the performance depreciation ratio is calculated (S560).

Meantime, as a result of determining whether the relative acceleration error is greater than the set value according to step S550, if it is determined that the relative acceleration error is smaller than the set value(S550-No), it is determined that the propulsion system is normal(S570), and the propulsion system fault diagnosis is terminated.

According to the automatic train operation system in railway vehicles including the fault status diagnosis unit, the train speed can be controlled in response to fault diagnosis of the propulsion system by diagnosing the fault of the propulsion system generating the traction of the train.

Furthermore, the performance depreciation degree is calculated when there is developed a fault on the propulsion system, and the train speed can be controlled thereby.

Hence, headway of a train mismatched by performance depreciation of propulsion system can be prevented by controlling a train speed in response to performance depreciation degree of the propulsion system.

Furthermore, fault information of the propulsion system can be transmitted to an ATS to allow recognizing the fault of the propulsion system and rapidly establishing a measure thereto.

The above-mentioned automatic train operation system in railway vehicles according to the present disclosure may, however, be embodied in many different forms and should not be construed as limited to the embodiments set forth herein.

Thus, it is intended that embodiments of the present disclosure may cover the modifications and variations of this disclosure provided they come within the scope of the appended claims and their equivalents. While particular features or aspects may have been disclosed with respect to several embodiments, such features or aspects may be selectively combined with one or more other features and/or aspects of other embodiments as may be desired.

What is claimed is:

1. An automatic train operation system mounted on a railway vehicle and configured to control speed of the railway vehicle while performing automatic or unmanned operation, the system comprising:

a speed profile receiver configured for generating speed profile information based on a limited speed profile received from on-board equipment or a tachometer;

a database configured for storing track gradient information and track curvature information for each of a plurality of track segments;

a controller configured for controlling the speed of the railway vehicle using a current position of the railway vehicle, a current speed of the railway vehicle and the generated speed profile information; and a propulsion system fault determiner configured for:

determining fault status of a propulsion system based on the current speed, the track gradient information, the track curvature information and propulsion notch information;

calculating a performance depreciation ratio when a fault in the propulsion system is determined; and providing the performance depreciation ratio to the controller, wherein the controller is further configured for compensating for the performance depreciation ratio by increasing a propulsion notch value according to the provided performance depreciation ratio, wherein the propulsion system fault determiner comprises:

a traction calculator configured for calculating a required traction using the current speed and the propulsion notch information; and a required acceleration calculator configured for calculating a required acceleration using the current speed, the calculated required traction, the track curvature information and the track gradient information;

wherein the propulsion system fault determiner determines that the propulsion system is abnormal when a status acceleration error value is greater than a set value and determines that the propulsion system is normal otherwise, and wherein the status acceleration error value is calculated by subtracting the current acceleration from the required acceleration and dividing the result by the required acceleration.

2. The system of claim 1, wherein the current position, the track gradient information and the track curvature information are provided in response to a request received from the propulsion system fault determiner.

3. The system of claim 1, wherein the controller is further configured for:

outputting a propulsion command when a profile speed at the current position is greater than the current speed; and outputting a brake command when the profile speed at the current position is less than the current speed.

4. The system of claim 1, wherein the controller is further configured for outputting the propulsion notch information in proportion to size of an error between a profile speed at the current position and the current speed.

5. The system of claim 1, wherein the propulsion system fault determiner further comprises:

an acceleration calculator configured for calculating current acceleration using the current speed and a previously stored speed; and a performance depreciation ratio calculator configured for:

calculating the performance depreciation ratio according to a degree of error by calculating a relative acceleration error based on the calculated current acceleration and the calculated required acceleration; and determining a fault in the propulsion system when the calculated relative acceleration error is greater than a threshold value.

6. The system of claim 5, wherein the traction calculator comprises a look-up table configured by the propulsion notch information and the calculated required traction at each of a plurality of speeds and is further configured for calculating the required traction using the look-up table.

7. The system of claim 5, wherein the propulsion system fault determiner further comprises storage for storing the current speed and is further configured for providing the stored current speed to the acceleration calculator.

8. The system of claim 5, wherein the required acceleration calculator is further configured for calculating the required acceleration using the following Equation:

$$A_D(k) = \frac{F_D(k) - c_1 - c_2 V(k) - c_3 V(k)^2 - c_4 / r(k) - mg\sin\theta(k)}{m}$$

where, $A_D(k)$ is a predicted required acceleration based on the current speed and a propulsion notch, $F_D(k)$ is the calculated required traction, $c_1$, $c_2$, $c_3$ are constants related to running resistances, V(k) is the current speed, m is an equivalent mass of the railway vehicle, g is a gravitational acceleration constant, r(k) is the track curvature, $c_4$ is a constant related to curvature resistance, and θ(k) is the track gradient.

9. The system of claim 5, wherein the performance depreciation ratio calculator is further configured for calculating the performance depreciation ratio using the following Equation:

$$DR = (1-\alpha)\times\left(\frac{A_D(k)-A(k)}{A_D(k)}-\alpha\right)\times 100[\%]$$

where, DR is the performance depreciation ratio, $A_D(k)$ is the calculated required acceleration, A(k) is the calculated current acceleration, $\alpha(0<\alpha<1)$ is a set value and, $$\frac{A_D(k)-A(k)}{A_D(k)}$$

is the calculated relative acceleration error.

10. The system of claim 5, wherein:

the performance depreciation ratio is calculated as 0% when the calculated relative acceleration error is less than the threshold value;

the performance depreciation ratio is calculated as 100% when the calculated relative acceleration error is greater than 1; and the performance depreciation ratio is proportionally calculated in response to a {100/(1-set value)} value when the calculated relative acceleration error is between the threshold value and 1.

* * * * *